US005865492A

United States Patent [19]

Horton

[11] Patent Number: 5,865,492

[45] Date of Patent: Feb. 2, 1999

[54] HYDRAULIC GRAPPLE ASSEMBLY WITH SIDE ROTATION MECHANISM

[75] Inventor: Lee A. Horton, Jefferson, Mass.

[73] Assignee: WEC Company, Rockford, Ill.

[21] Appl. No.: 779,910

[22] Filed: Jan. 7, 1997

[51] Int. Cl.[6] ..... B66C 3/04

[52] U.S. Cl. ..... 294/86.41; 294/104; 294/88; 414/732; 414/740

[58] Field of Search ..... 94/86.41, 88, 104, 94/106, 68.22, 68.23; 414/723, 724, 732, 740; 37/468, 461, 184

[56] References Cited

U.S. PATENT DOCUMENTS

| | | | |
|---|---|---|---|
| 2,776,768 | 1/1957 | Calson | 414/740 |
| 2,903,803 | 9/1959 | Austin, Sr. | 294/104 |
| 3,152,706 | 10/1964 | Conrad | 294/104 |
| 3,165,347 | 1/1965 | Keskitalo | 414/740 |
| 3,767,070 | 10/1973 | Arnold | 294/104 |
| 3,854,608 | 12/1974 | Arnold | 214/145 |
| 3,934,738 | 1/1976 | Arnold | 214/145 A |
| 4,017,114 | 4/1977 | LaBounty | 294/88 |
| 4,104,792 | 8/1978 | LaBounty | 30/134 |
| 4,198,747 | 4/1980 | LaBounty | 414/740 |
| 4,248,471 | 2/1981 | LaBounty | 294/88 |
| 4,268,217 | 5/1981 | Perreault et al. | 294/104 |
| 4,311,428 | 1/1982 | Arnold | 414/723 |
| 4,542,929 | 9/1985 | Possinger | 294/88 |
| 4,558,515 | 12/1985 | LaBounty | 294/104 |
| 4,854,814 | 8/1989 | Smith et al. | 414/723 |
| 4,906,161 | 3/1990 | Weyer | 414/723 |
| 4,907,356 | 3/1990 | Labounty | 37/117.5 |
| 4,958,981 | 9/1990 | Uchihashi | 414/694 |
| 5,145,313 | 9/1992 | Weyer | 37/468 |
| 5,237,762 | 8/1993 | Sandberg | 37/468 |
| 5,328,223 | 7/1994 | Maggio | 294/86 |
| 5,515,626 | 5/1996 | Hölscher | 414/723 |

OTHER PUBLICATIONS

"New from Wain–Roy—More Safety. More Economy. More Versatility.—Remote Hydraulic Quick Coupler; Quick Change Jaw®; Piggy Ban Swinger", Wain–Roy®, Inc., Hubbardston, MA, Feb., 1995.

"Wain–Roy® Jaw and Quick Change Jaw", Wain–Roy®, Hubbardston, MA, Oct., 1992.

"NYe® Nye Manufacturing Ltd. Custom Attachments", Nye Manufacturing Ltd., Mississauga, Ontario, Canada, 1992.

"Wain–Roy® Versatile Jaw® and Rota–Jaw® Bucket", Wain–Roy®, Inc., Hubbardston, MA, 1990.

"Get Unmatched Job Efficiencies with *Wain–Roy*® Quick Change Toolhitch® Coupler System", Wain–Roy®, Inc., Hubbardston, MA, Aug., 1985.

*Primary Examiner*—Dean Kramer

*Attorney, Agent, or Firm*—Fish & Richardson, P.C.

[57] ABSTRACT

A hydraulic grapple assembly couples to a link pivot and to a dipper pivot of an arm of an equipment. The assembly includes a grapple having a fixed jaw and a movable jaw. The fixed jaw extends in a direction substantially parallel to an imaginary line drawn between the link pivot and the dipper pivot when the grapple assembly is coupled to the arm. A distal end of the fixed jaw is positioned closer to the link pivot than to the dipper pivot when the grapple is coupled to the arm. The movable jaw has a proximal end coupled to a proximal end of the fixed jaw by an articulation. A hydraulic grapple actuator moves a distal end of the movable jaw between open and closed positions relative to a distal end of the fixed jaw. The grapple assembly can include a hydraulic swinger mechanism that rotates the grapple about an axis that is approximately aligned with the imaginary line through the dipper pivot and the link pivot.

29 Claims, 10 Drawing Sheets

HYDRAULIC GRAPPLE ASSEMBLY WITH SIDE ROTATION MECHANISM

BACKGROUND OF THE INVENTION

The invention relates to a hydraulic grapple for attachment to a movable arm.

Hydraulic grapples have two jaws that can move relative to each other to clamp onto objects. Similar to many other construction industry tools, such as buckets and the like, grapples can couple to a dipper stick at the end of an articulated arm of a heavy construction equipment. Grapples typically include structure that couples to the end of the arm's dipper stick at a dipper pivot, and structure that couples to a linkage to the arm's bucket cylinder at a link pivot.

U.S. Pat. No. 4,248,471 describes a grapple that includes a front jaw strut that is articulated from the dipper pivot and is coupled to the link pivot. The rear jaw is articulated from a part of the front jaw that extends past the dipper pivot. A strut extends from the back side of the rear jaw and connects to the underside of the dipperstick. Extending the rod of the bucket cylinder on the arm closes the front jaw against the rear jaw, and retracting the bucket cylinder rod opens the grapple.

Strut-type grapples can also couple indirectly to the equipment arm with the use of a tool coupler. For example, the QC Grapple, provided by Wain-Roy, Inc. of Hubbardston, Mass., is designed to work with the Wain-Roy TOOLHITCHO® Coupler System, which is described in U.S. Pat. No. 4,311,428.

Other grapples lack the strut to the rear jaw. For example, U.S. Pat. No. 4,542,929 describes a clam-type grapple having two movable jaws, each articulated from a coupling portion and each actuated by a hydraulic cylinder. The coupling portion connects to both the dipper pivot and to the link pivot.

Some strutless grapples include a rotation mechanism. For example, the clam-type grapple described in U.S. Pat. No. 4,542,929 includes a mechanism that rotates the grapple about an axis that bisects the angle between the jaws. The rotation axis is approximately perpendicular to an imaginary line that extends through the dipper pivot and the link pivot.

U.S. Pat. No. 4,017,114 also describes a grapple having a mechanism for rotating the grapple about a similarly oriented axis. This grapple differs from the clam-type grapple in that it has a fixed jaw attached to the rotation mechanism. A proximal end of a movable jaw is articulated from a proximal end of the fixed jaw closest to the coupling to the arm of the equipment. The fixed jaw is substantially aligned with the rotation axis. A single grapple cylinder actuates the movable jaw. In both types of grapples with rotation mechanisms, extending and retracting the bucket cylinder rotates the entire grapple around the dipper pivot.

SUMMARY OF THE INVENTION

According to one aspect of the invention, a hydraulic grapple couples to a link pivot and a dipper pivot of an arm of an equipment. The grapple includes a fixed portion, including a fixed jaw projecting in a direction substantially parallel to an imaginary line drawn between the link pivot and the dipper pivot when coupled to the arm. A distal end of the fixed jaw is positioned closer to the link pivot than to the dipper pivot when the grapple is coupled to the arm. A movable jaw has a proximal end coupled to a proximal end of the fixed portion by a pivot connection. A hydraulic actuator is structured and arranged to move a distal end of the movable jaw between open and closed positions relative to a distal end of the fixed jaw. The actuator includes a cylinder coupled to the movable arm at a point distal the articulation, and a rod extendable from the cylinder. The actuator is mounted between the movable arm and the fixed arm, being aligned substantially parallel to the imaginary line when the grapple is in the open position. Extending the rod from the cylinder urges the movable arm towards the closed position.

The proximal end of the fixed jaw can be coupled to a body that includes structure adapted to couple directly to the link pivot and the dipper pivot, for example, with pins. Alternatively, the body can include structure to couple indirectly to the link pivot and the dipper pivot, for example, with a tool coupler that includes pins for coupling to the link pivot and dipper pivot.

The tool coupler, which may be a quick-disconnect coupler, can include a swinger mechanism for rotating the grapple about an axis approximately parallel to the imaginary line. If the body couples directly to the link and dipper pivots, the body may include the swinger mechanism.

According to another aspect of the invention, a grapple assembly has a coupling portion, including a fixed part structured to be coupled to a link pivot and to a dipper pivot of an arm of an equipment. The coupling portion also includes a movable part, and a swinger mechanism for rotating the movable part about a swinger axis approximately aligned with an imaginary line drawn between the link pivot and the dipper pivot when the grapple assembly is coupled to the arm. The grapple of the grapple assembly includes a fixed jaw and a movable jaw. The fixed jaw, which is preferably approximately aligned with the swinger axis, has a proximal end connected to the movable part of the coupling portion and a distal end extending away from the coupling portion. In one embodiment, the distal end of the fixed jaw is closer to the link pivot than to the dipper pivot when the grapple is coupled to the arm. The movable jaw includes a proximal end articulated near the movable part of the coupling portion and a distal end extending away from the coupling portion. A hydraulic actuator is structured and arranged to move the distal end of the movable jaw between open and closed positions relative to the distal end of the fixed jaw.

The fixed part of the coupling portion can couple directly to the link pivot and the dipper pivot, for example, with pins. Alternatively, the fixed part of the coupling portion can couple indirectly to the link pivot and the dipper pivot with a tool coupler.

The grapple is able to take advantage of the full range of motion of the bucket cylinder due to the angle in which the jaws close in relation to the dipper and link pivots. The grapple can be positioned so that the movable jaw nibbles at the underside of an object. Due to the movable jaw being positioned closer to the operator than the fixed jaw, the grapple better simulates the movement of a thumb on a hand, and picking up and placing objects is made easier.

The jaws have a long, thin shape, particularly in comparison to buckets which have a jaw attachment. The aspect ratio of the length to the front-to-back depth of each jaw is at least approximately 2:1. This feature allows an operator to lower objects gently and precisely into a narrow opening, such as into a truck bed or a trench, rather than dropping the object from a height. When used in conjunction with a swinger mechanism that provides side-to-side positioning capability, an operator can maneuver the grapple to place objects with great precision. For example, an operator can build rock walls, place pipe in trenches, lower objects into trucks, and lay objects on angled embankments.

The grapple cylinder, being mounted on the movable jaw, can be protected from rocks or other objects by a rib or sheet of steel. Also, because the bore side of the cylinder is used for closing the jaws, the grapple makes the best use of the grapple cylinder's hydraulic power. Another advantage of this hydraulic arrangement is that the jaws do not tend to creep open because of valve spool leakage and the difference of the rod and bore areas.

BRIEF DESCRIPTION OF THE DRAWING

In FIG. 10, the grapple is rotated to a vertical position, and in FIG. 11 the grapple is rotated to an extreme side-rotated position. The movable jaw is not shown to simplify the drawing.

DETAILED DESCRIPTION OF THE INVENTION

Figure 1:
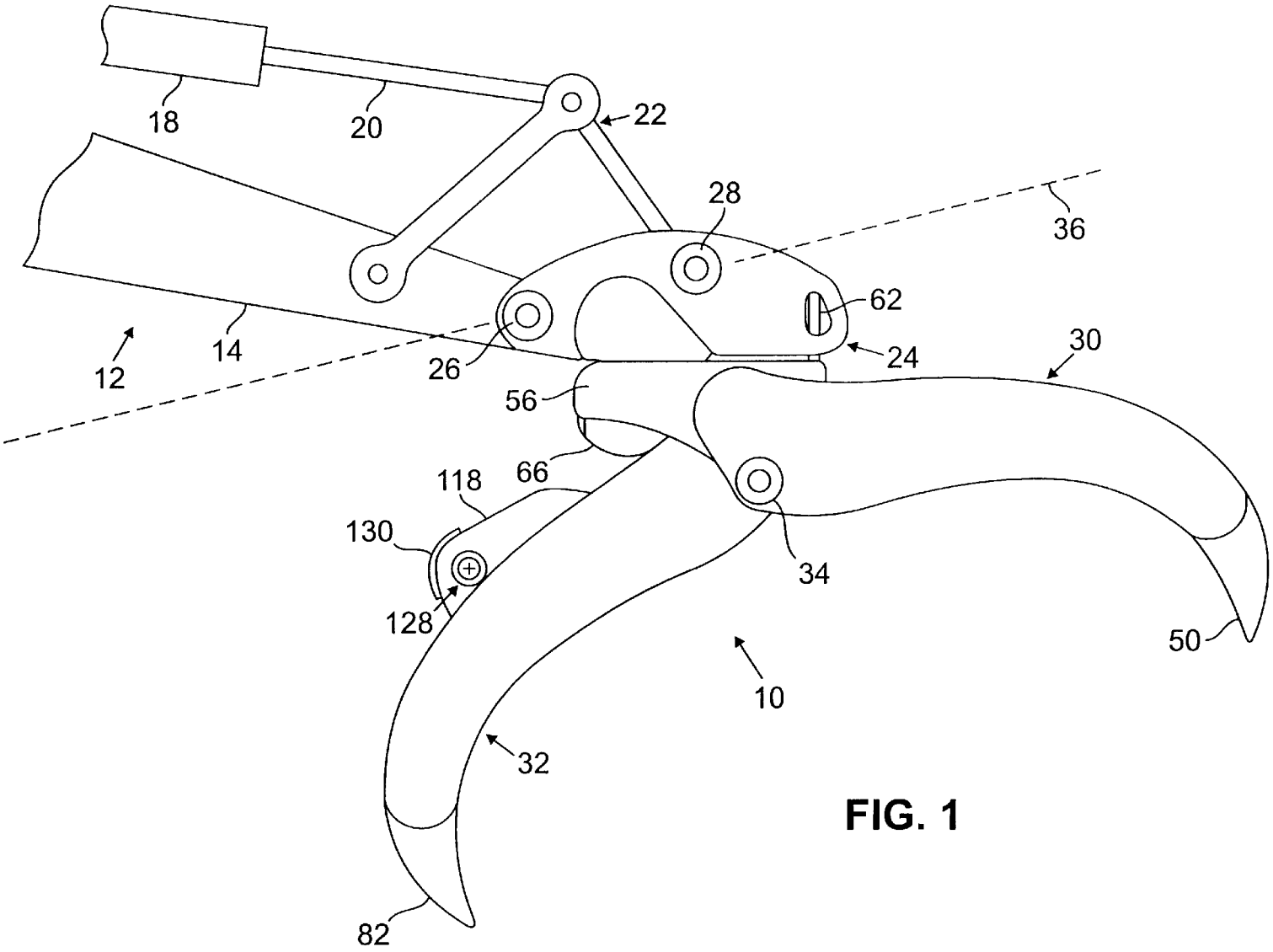
FIG. 1 is an elevation view of a hydraulic grapple according to the invention in an open position, the grapple being coupled to the arm of an equipment by a quick-connect tool coupler.
Figure 2:
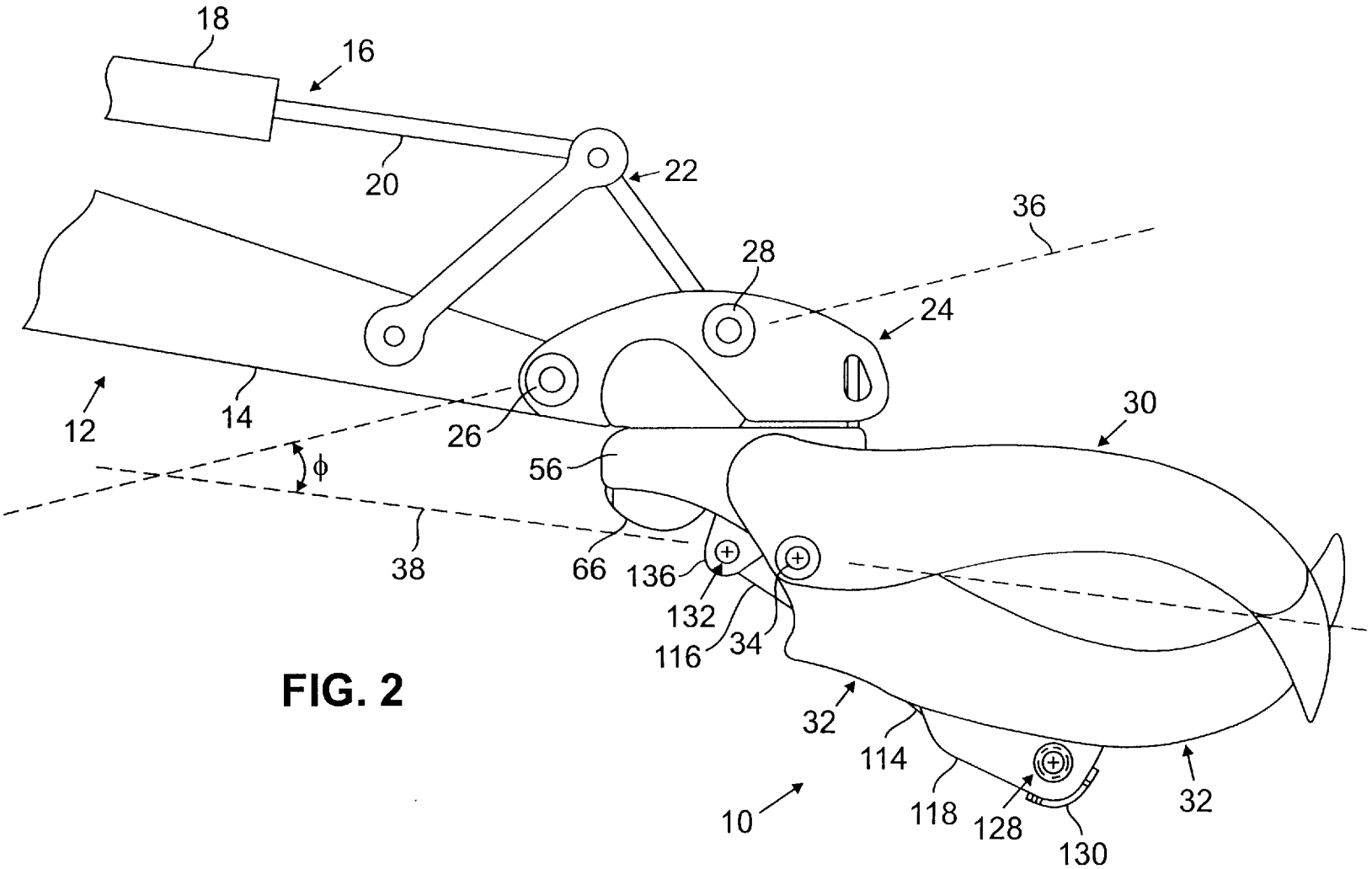
FIG. 2 is an elevation view of the grapple illustrated in FIG. 1, shown in the closed position.

Referring now to FIGS. 1 and 2, a hydraulic grapple 10 is shown coupled to an arm 12 of a construction equipment, such as, for example, a JOHN DEERE® model 490D excavator. The arm 12 includes a dipperstick 14 and a bucket cylinder 16 extending along an upper portion of the dipperstick 14. The dipper stick 14 and a fixed portion 18 of the bucket cylinder 16 are coupled together near their proximal ends (not shown). A distal end of the bucket cylinder's movable rod 20 is coupled to a linkage 22, which is articulated from the distal end of the dipper stick 14.

The grapple 10 is coupled to the arm 12 by a quick-connect tool coupler 24. In the described embodiment the tool coupler 24 is a rigid coupler, which can be provided, for example, by a TOOLHITCH® coupler system, produced by Wain-Roy, Inc. of Hubbardston, Mass. Couplers of this general type and their manner of use are described in commonly owned U.S. Pat. Nos. 3,934,738, 4,311,428, and co-pending application Ser. No. 08/634,561, now U.S. Pat. No. 5,727,342 all of which are included herein by reference. The tool coupler 24 attaches to the distal end of the dipperstick 14 at a dipper pivot 26, and also couples to the linkage 22 at a link pivot 28.

The grapple 10 includes a fixed portion having structure for coupling to the underside of the tool coupler 24, which will be described in greater detail below. Grapple 10 includes a fixed jaw 30 and a movable jaw 32, which articulates from a proximal end of the fixed jaw 30 at a grapple pivot 34. In the following description of the grapple 10, the terms "proximal" and "distal" will refer, respectively, to components that are closer to and farther away from the tool coupler 24 or arm 12. "Forward" or "front" will refer to a direction from the dipper pivot towards the link pivot (to the right in FIG. 1), and "rearward" and "rear" will refer to the opposite direction (to the left in FIG. 1).

FIG. 1 illustrates the grapple 10 with the movable jaw in a fully-extended, open position, and FIG. 2 illustrates the grapple 10 with movable jaw 32 in a fully closed position against the fixed jaw 30. Extending and retracting the movable rod 20 of the bucket cylinder 16 rotates the grapple 10 about a tilt axis provided by the dipper pivot 26. The tilt axis is perpendicular to an operational plane of the bucket cylinder 16, dipperstick 12 and linkage 22, and parallel to the grapple pivot 34.

The fixed jaw 30 extends substantially parallel to an imaginary line 36 connecting the dipper pivot 26 with the link pivot 28. A distal end of the fixed jaw 30 is closer to the link pivot than to the dipper pivot when the grapple is coupled to the arm. The direction that the fixed jaw extends is approximately along the direction of a second imaginary line 38. The second imaginary line, which extends through the grapple pivot 34 and bisects the jaws 30, 32 when they are closed together, forms a small included angle $\phi$ with the first mentioned imaginary line 36. Angle $\phi$ will depend on the location of the dipper pivot 26 and the link pivot 28 on the tool coupler 24, and the manner in which the fixed jaw 30 and the tool coupler 24 are connected. Generally, the second mentioned imaginary line 38 will be directed slightly below the first mentioned imaginary line 36 in a forward direction. Preferably, angle $\phi$ is about 30° or less. In the described embodiment, angle $\phi$ is about 21°.

Figure 3:
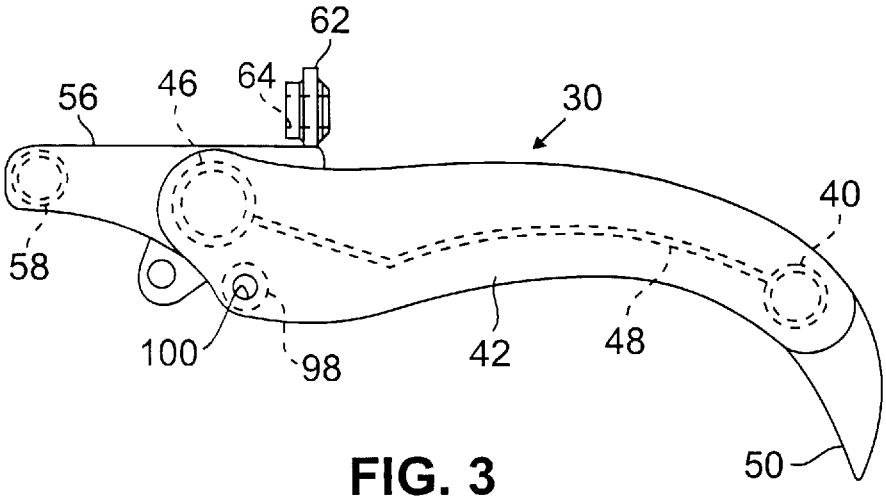
FIG. 3 is side elevation view of the fixed jaw of the grapple of FIG. 1.
Figure 4:
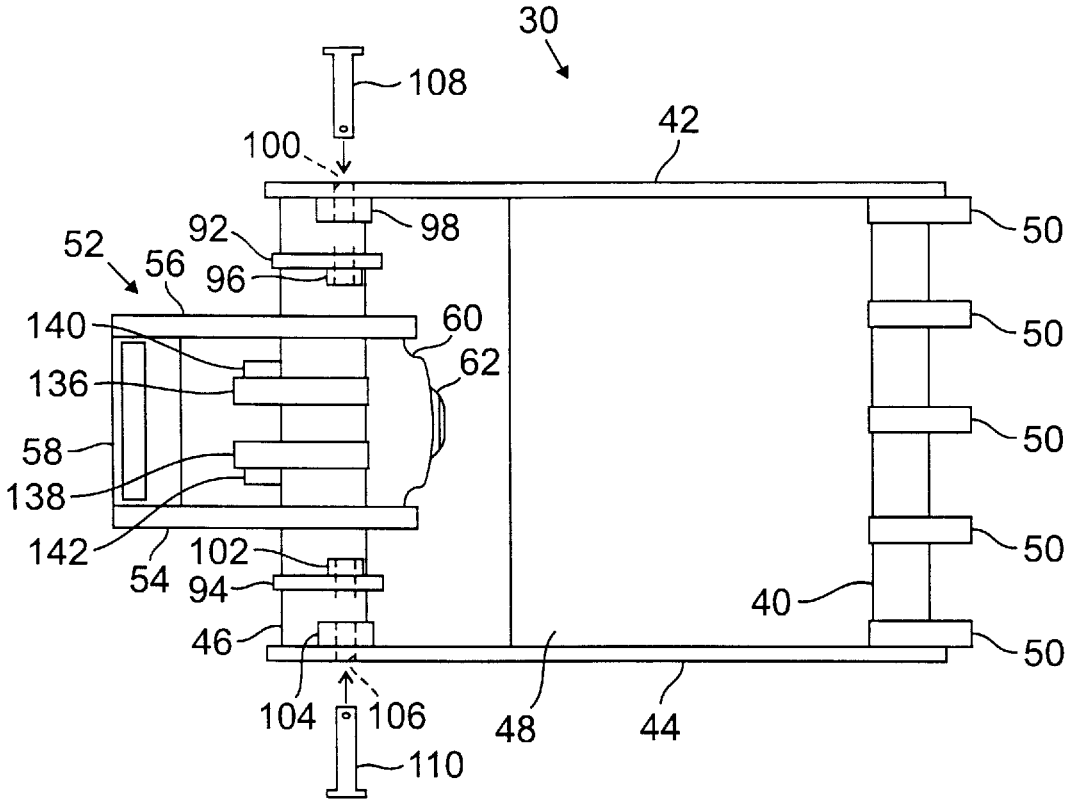
FIG. 4 is bottom plan view of the fixed jaw illustrated in FIG. 3.

Referring now also to FIGS. 3 and 4, fixed jaw 30 includes parallel side plates 42, 44, and support tubes 40, 46 at distal and proximal ends, respectively, extending between side plates 42, 44. Back plate 48 closes the opening between side plates and between support tubes 40, 46. Five tines 50 are welded or otherwise attached to the distal support tube 40.

The proximal end of the fixed jaw 30 includes coupler connecting structure 52 for connecting to the tool coupler 24. The connecting structure 52 includes a pair of side plates 54, 56 welded to support tube 46. A cross-tube 58 extends between the side plates 54, 56 at one end of the connecting structure 52. At a forward end, a cross-plate 60 supports an upright fitting 62 that has a bore 64. When coupling the grapple 10 to the tool coupler 24, a rearward-curling hook 66 on the underside of the tool coupler 24 (see FIG. 1) first engages with the cross-tube 58, and then a latch pin (not shown) on the tool coupler 24 is engaged with the fitting 62 on the fixed jaw 30 and 24. The grapple 10 can be used with other types of tool couplers by modifying the coupler connecting structure.

Figure 5:
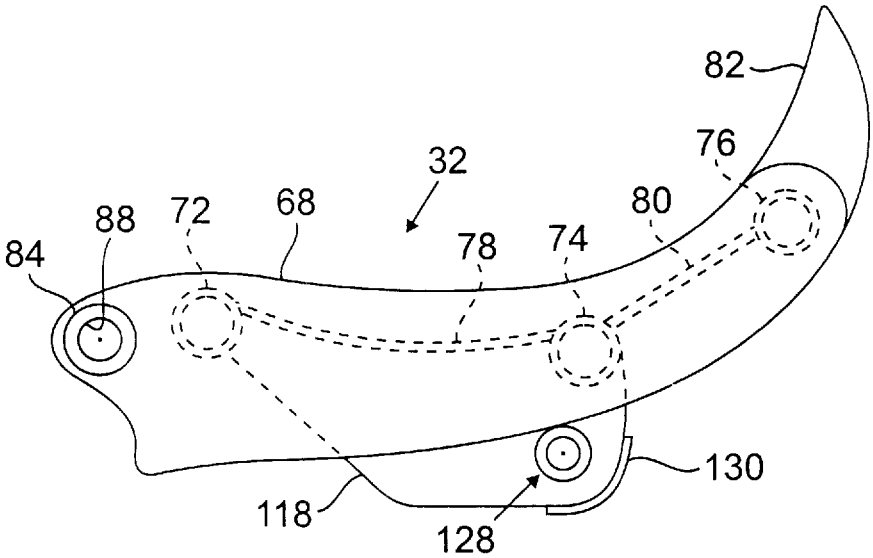
FIG. 5 is side elevation view of the movable jaw of the grapple of FIG. 1.
Figure 6:
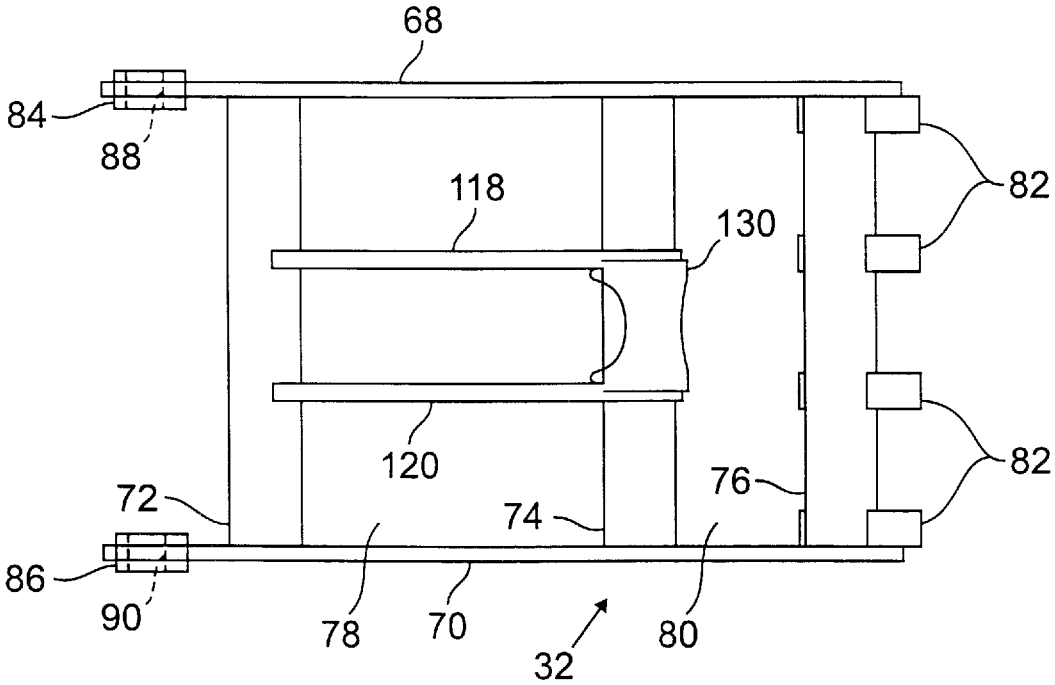
FIG. 6 is a bottom plan view of the movable jaw illustrated in FIG. 5.

Referring now to FIGS. 5 and 6, movable jaw includes side plates 68, 70, which are connected by proximate, middle and distal support tubes 72, 74, 76. Proximate and distal back plates 78, 80 connect between the side plates 68, 70. The back plates 78 and 80 on the movable jaw 32 and back plate 48 on the fixed jaw 30 inhibit material being held by the grapple from falling out through the front or rear of the grapple 10. Four tines 82 are welded or otherwise attached to the distal support tube 76. Tines 82 interlace with the tines 50 on the fixed jaw 30 when the movable jaw is closed against the fixed jaw 30 (see FIG. 7). The proximate ends of the plates 68, 70 include respective fittings 84, 86, which each have a bore 88, 90.

The grapple pivot 34 will now be described, with further reference to FIG. 7. Fixed jaw 30 includes a pair of ears 92, 94 that are welded to the proximate support tube 46 between plates 42 and 56, and between plates 44 and 54, respectively. Plate 42 and ear 92 have fittings 96 and 98, respectively, which together form a pivot bore 106. Similarly, plate 44 and ear 94 have fittings 102 and 104, respectively, which together form a second pivot bore 106. When the grapple 10 is assembled, the movable jaw fitting 84 is positioned between the fixed jaw fittings 96 and 98, and the movable jaw fitting 86 is positioned between the fixed jaw fittings 102 and 104, such that bores 88 and 100 are aligned together and bores 90 and 106 are aligned together. A first grapple pivot pin 108 is then inserted through bores 100 and 88, and a second grapple pivot pin 110 is inserted through bores 90 and 106. The pivot pins 108 and 110 can be set with cross pins (not shown).

Figure 7:
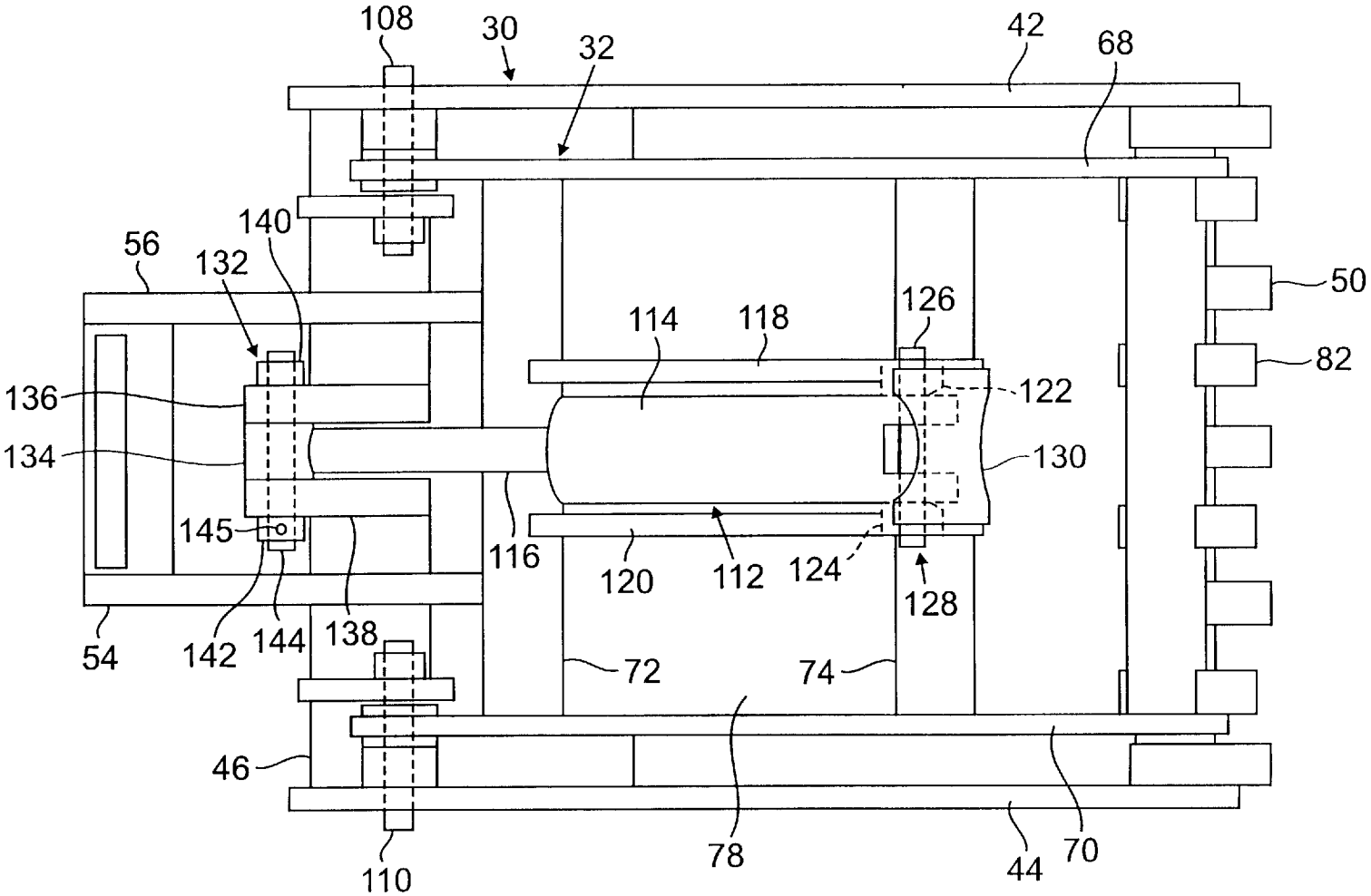
FIG. 7 is a bottom plan view of the grapple of FIG. 2.
Figure 8:
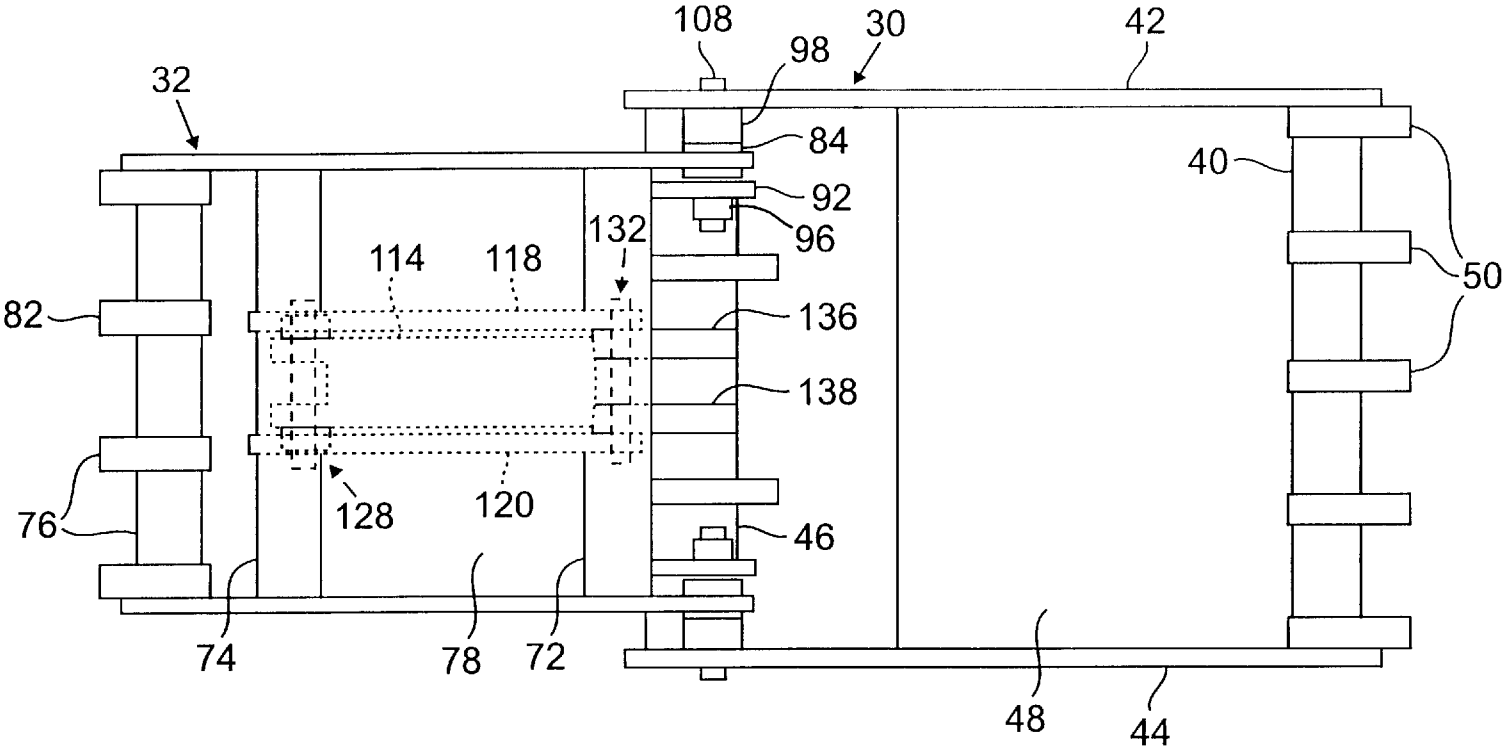
FIG. 8 is a bottom plan view of the grapple of FIG. 1.

Referring now also to FIGS. 7 and 8, the assembled grapple 10 is shown with a double-action hydraulic actuator 112 coupling the movable jaw 32 to the fixed jaw 30. The hydraulic lines are not shown to simplify the illustration. The actuator 112 includes a cylinder 114 and a movable rod 116. The movable jaw has a pair of plates 118, 120 welded between the middle support tube 74 and the proximate support tube 72. Fittings 122, 124 are attached to the plates 118, 120, respectively, near the middle support tube 74. The fittings 122, 124, and the distal end of the cylinder 114 have aligned bores through which a pin 126 is inserted. A smaller cross-pin (not shown) is inserted through a cross-bore in one of the fittings 122, 124 and pin 126 to hold pin 126 in place and completes a rotatable distal actuator connection 128 between the movable jaw and the cylinder. Back plate 78, side plates 118, 120, and a shroud 130 protect the cylinder during operation of the bucket 10.

The actuator rod 116 is coupled to a proximal end of the fixed jaw by a proximal actuator connection 132. The proximal end of the rod 116 includes a rod eye fitting 134 having a cross-bore. The rod eye fitting 134 fits between a pair of plates 136, 138 that are welded or otherwise fixed to the fixed jaw's proximal support tube 46. The plates 136, 138 have fittings 140, 142 that also have bores, which align with the cross bore of the rod eye fitting 134 so that a pin 144 can be inserted therethrough. A smaller pin 145 is inserted into a cross-bore through fitting 142 and pin 144 to keep pin 144 from slipping out when the grapple 10 is operated. Thus, the proximal actuator connection 132 and the distal actuator connection 128 provide rotatable connections to the fixed jaw and to the movable jaw, respectively.

Pressurizing the bore side of the actuator 112 extends the rod 116 from the cylinder, closing the movable jaw 32 against the fixed jaw 30. Pressurizing the rod side of the actuator 112 retracts the rod 116 into the cylinder 116, rotating the distal end of the movable jaw 32 away from the distal end of the fixed jaw 30. More force is available for clamping the grapple due to the difference in the respective surface areas of the bore end and the rod end of the cylinder.

Figure 9:
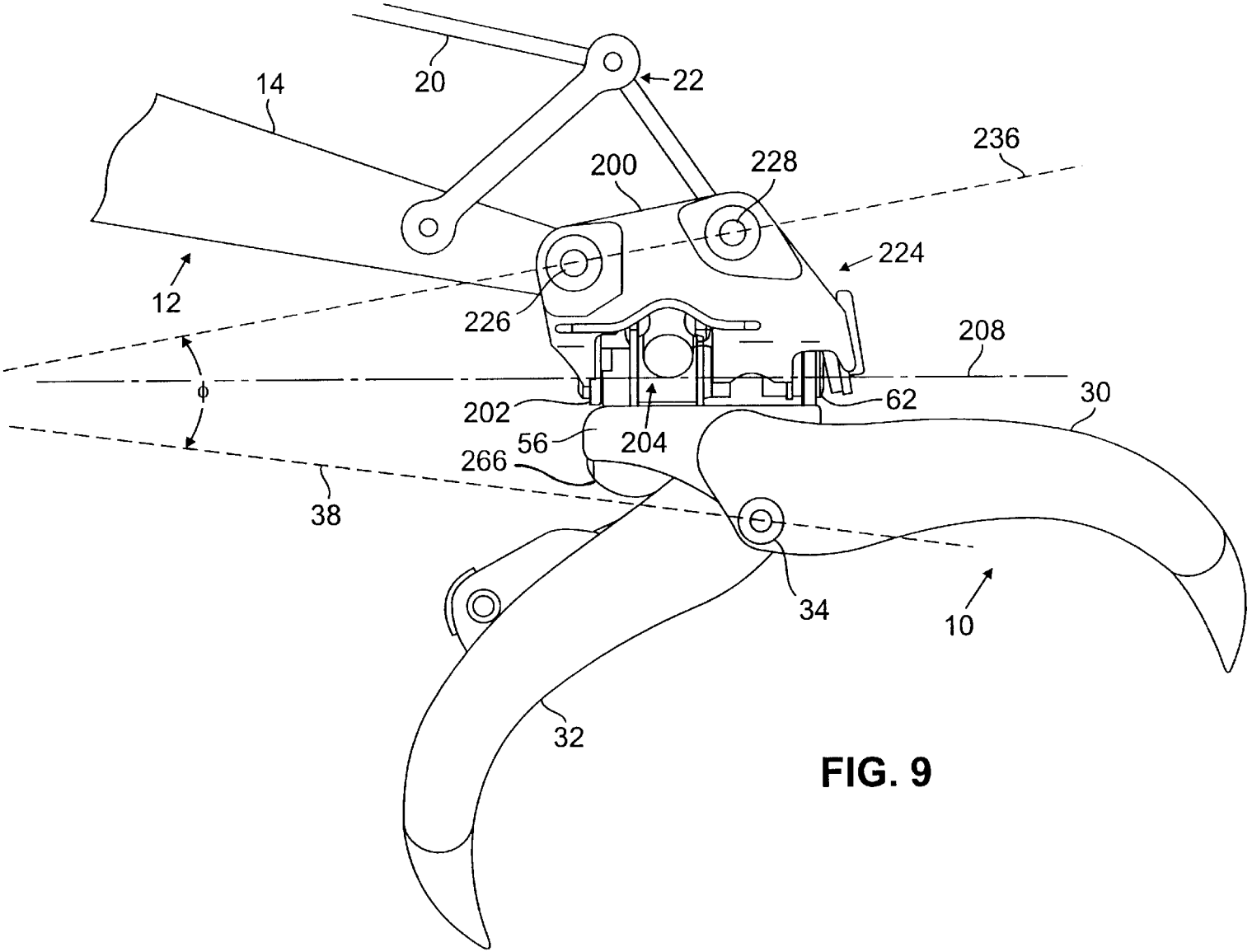
FIG. 9 is a side elevation view of a grapple assembly, which includes a swinger mechanism, coupled to the arm of a construction equipment.
Figure 10:
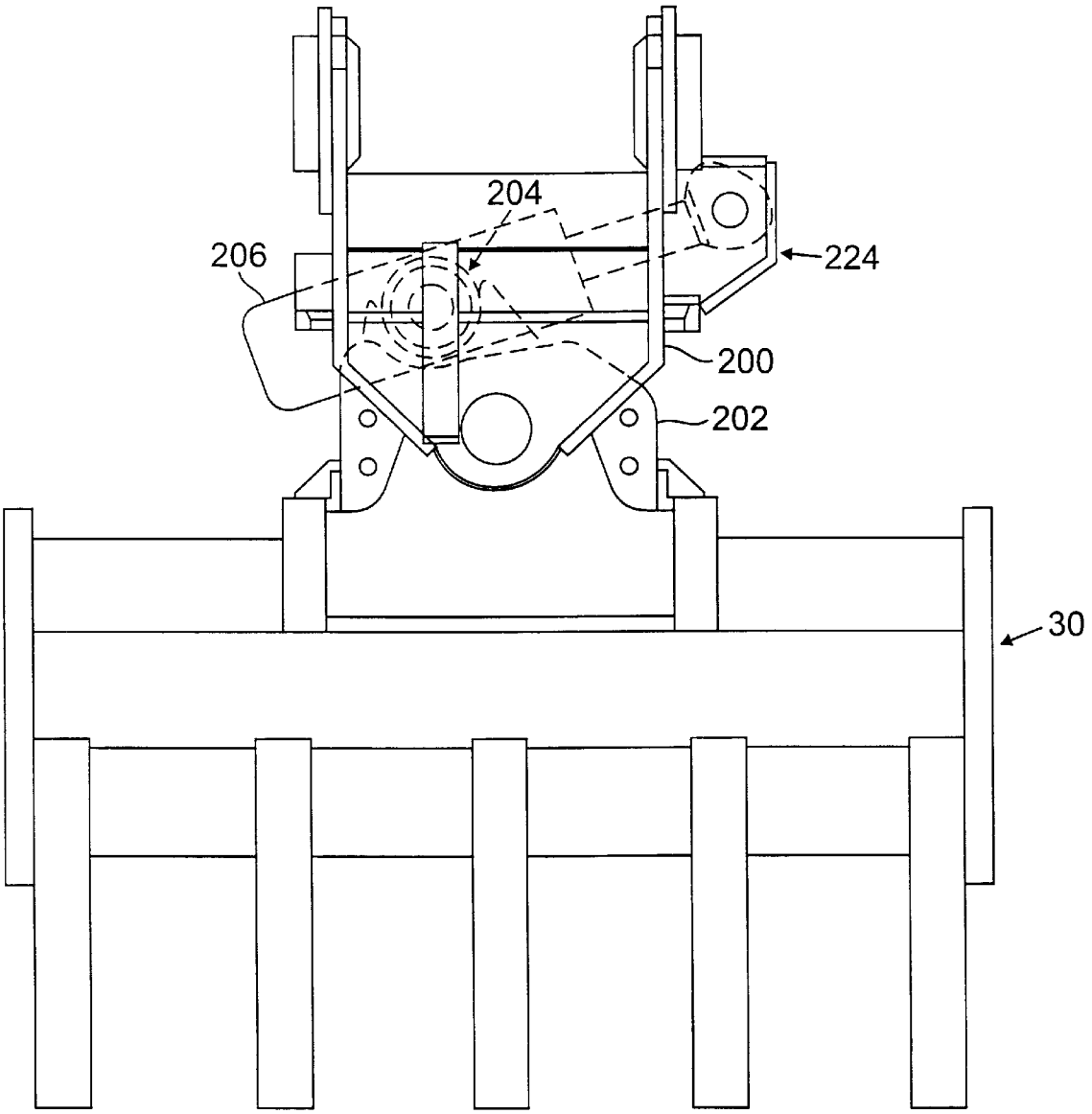
FIGS. 10 and 11 are front elevation views of the grapple assembly of FIG. 9 detached from the equipment arm.
Figure 11:
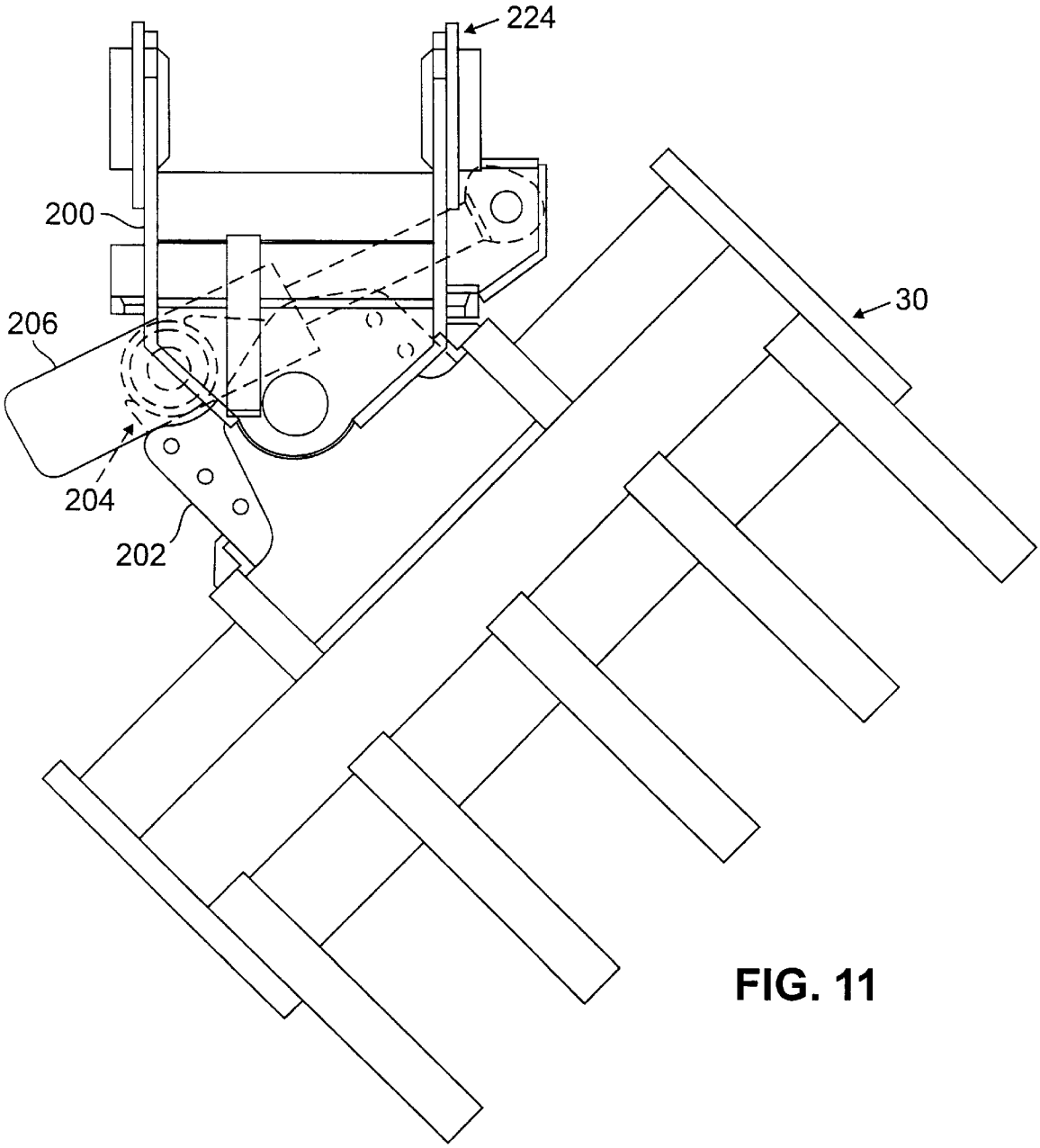

Another embodiment of a grapple assembly is illustrated in FIGS. 9–11. The grapple assembly, which includes the grapple 10 described above with reference to FIGS. 1–8, is shown in FIG. 9 coupled to the arm 12 of an equipment by a quick-connect swinger coupler 224. In FIGS. 10 and 11, the grapple assembly is shown detached from the arm, and without the movable jaw 32, so as to simplify the illustration. Swinger couplers utilizing the WAIN-ROY® TOOL-HITCH® Coupler System are available in different sizes from Wain-Roy, Inc. of Hubbardston, Mass. Swinger coupler 224 has a fixed upper portion 200, which includes a dipper pivot 226 for rotatably attaching to the dipper stick 14, and link pivot 228 that rotatably couples to the linkage 22. A movable lower portion 202 of swinger coupler 224 includes a hook 266 for engaging the cross-tube 58 on the fixed jaw 30, and a fitting (not shown) that, along with fitting 62 on the fixed jaw 30, can be engaged with a latch pin. The upper portion 200 is coupled to the lower portion 202 by a trunnion assembly 204, which includes a swinger hydraulic cylinder 206. The trunnion assembly 204 rotates the lower portion 202 about a swinger axis 208 that is approximately aligned with the fixed jaw 30 and with the imaginary line 236 going through the dipper pivot 226 and the link pivot 228. In the described embodiment, angle $\phi$ is about 17°, the swinger axis 208 being aligned approximately 10° below the imaginary line 236 in the forward direction, and approximately 7° above the line 38 of the fixed jaw.

It will be appreciated that a grapple assembly according to the invention could be structured to couple directly to the arm of the equipment, without using the above-described tool couplers 24 and 224. For example, grapple 10 can be modified to connect directly to the dipper pivot 26 and the link pivot 28. Plates 54 and 56 can be extended upwards and include dipper and link pivot fittings to couple to the dipper pivot 26 and the link pivot 28, respectively.

Figure 12:
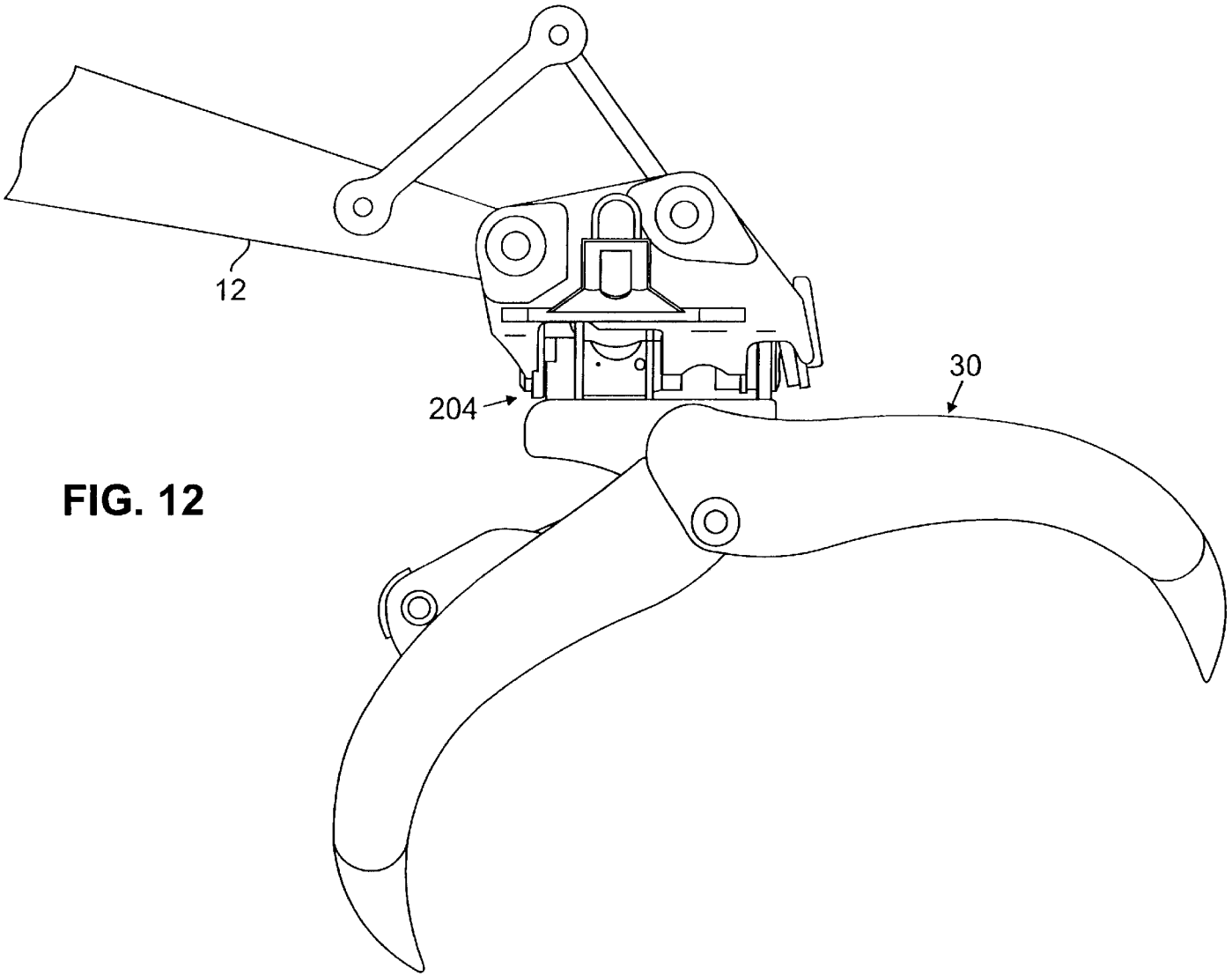
FIG. 12 is a side elevation view of a grapple with a swinger mechanism directly coupling to a dipper stick.

It will also be appreciated that the swinger mechanism 204 can be built into the fixed jaw 30, rather than into a tool coupler. For example, the movable lower portion of the swinger mechanism can be fixed to the fixed jaw 30 of the grapple. The fixed upper portion of the swinger mechanism can be structured to connect directly to the arm 12 of the equipment as shown in FIG. 12, or it can be structured to couple indirectly to the arm 12 by using a rigid tool coupler, such as, for example, tool coupler 24 described above.

What is claimed is:

1. A grapple for coupling to a link pivot and a dipper pivot of an arm of an equipment, comprising:

a fixed portion, including a fixed jaw that comprises a proximal end and a distal end extending in a direction substantially parallel to an imaginary line drawn between the link pivot and the dipper pivot when the grapple is coupled to the arm; and a movable jaw having a proximal end coupled to a proximal end of the fixed portion by a grapple pivot, wherein each of the fixed and the movable jaws includes spaced side members and connecting members connecting between the side members, the fixed and movable jaws being structured and arranged to cooperatively grasp objects therebetween.

2. The grapple of claim 1, wherein a distal end of the fixed jaw is closer to the link pivot than to the dipper pivot when the grapple is coupled to the arm.

3. The grapple of claim 2, further comprising a hydraulic actuator structured and arranged to move a distal end of the movable jaw between open and closed positions relative to a distal end of the fixed jaw.

4. The grapple of claim 3, wherein the actuator includes a cylinder and a rod extendable from the cylinder, the actuator being mounted between the movable jaw and the fixed jaw, the actuator being aligned substantially parallel to the imaginary line in the open position, and extending the rod from the cylinder urges the movable jaw towards the closed position.

5. The grapple of claim 4, wherein the cylinder is coupled to the movable jaw at a point distal the grapple pivot.

6. The grapple of claim 1, wherein the proximal end of the fixed jaw is coupled to a body that includes structure adapted to couple directly to the link pivot and the dipper pivot.

7. The grapple of claim 1, wherein the proximal end of the fixed jaw includes a body comprising structure adapted to couple to a tool coupler that couples to the link pivot and dipper pivots.

8. The grapple of claim 7, in combination with the tool coupler.

9. The combination of claim 8, wherein the tool coupler includes a mechanism for rotating the grapple about an axis approximately aligned with the imaginary line.

10. The combination of claim 9, wherein the tool coupler is a quick-disconnect coupler.

11. The combination of claim 8, wherein the tool coupler is a quick-disconnect coupler.

12. The grapple of claim 1, further comprising a mechanism for rotating the grapple about an axis approximately aligned with the imaginary line.

13. The grapple of claim 1, further including a grapple actuator mounted between the movable jaw and the fixed portion to rotate the movable jaw about the grapple pivot to an open position in which the movable jaw is at an obtuse angle relative to the fixed jaw.

14. The grapple of claim 1, wherein each of the fixed and movable jaws has an aspect ratio, which is defined by the ratio of its length to its front-to-back depth, that is at least approximately 2:1.

15. A grapple assembly, comprising:

a coupling portion, including a fixed part structured to be coupled to a link pivot and to a dipper pivot of an arm of an equipment, a movable part, and a swinger mechanism for rotating the movable part about a swinger axis approximately aligned with an imaginary line drawn between the link pivot and the dipper pivot when the grapple assembly is coupled to the arm; and a grapple coupled to the movable part of the coupling portion, including first and second jaws, one of the jaws being pivoted to open and close against the other of the jaws, wherein the first law includes a proximal end connected to the movable part of the coupling portion and a distal end extending away from the coupling portion;

the second law includes a proximal end articulated near the movable part of the coupling portion and a distal end extending away from the coupling portion;

the grapple further includes a hydraulic actuator structured and arranged to move the distal end of the second jaw between open and closed positions relative to the distal end of the first jaw, wherein the actuator includes a movable rod and a cylinder, and wherein extending the rod from the cylinder urges the second law towards the closed position.

16. The grapple assembly of claim 15, wherein the fixed part of the coupling portion is structured to couple directly to the link pivot and to the dipper pivot.

17. The grapple assembly of claim 15, wherein the movable part of the coupling portion includes structure for removably coupling to the first jaw.

18. The grapple assembly of claim 17, wherein the coupling portion is a quick-connect tool coupler.

19. The grapple assembly of claim 15, wherein the first and second jaws are at an obtuse angle relative to each other in the open position.

20. A grapple assembly, comprising:

a coupling portion, including a fixed part structured to be coupled to a link pivot and to a dipper pivot of an arm of an equipment, a movable part, and a swinger mechanism for rotating the movable part about a swinger axis approximately aligned with an imaginary line drawn between the link pivot and the dipper pivot when the grapple assembly is coupled to the arm; and a grapple coupled to the movable part of the coupling portion, including a fixed law being approximately aligned with the swinger axis, and a movable law being pivoted to open and close against the fixed jaw.

21. The grapple assembly of claim 20, wherein the distal end of the fixed law is closer to the link pivot than to the dipper pivot when the grapple assembly is coupled to the arm.

22. the grapple assembly of claim 20, wherein the fixed part of the coupling portion is structured to couple directly to the link pivot and to the dipper pivot.

23. The grapple assembly of claim 20, wherein the movable part of the coupling portion includes structure for removably coupling to the fixed jaw.

24. A grapple assembly, comprising:

a coupling portion, including a fixed part structured to be coupled to a link pivot and to a dipper pivot of an arm of an equipment, a movable part, and a swinger mechanism for rotating the movable Dart about a swinger axis approximately aligned with an imaginary line drawn between the link pivot and the dipper pivot when the grapple assembly is coupled to the arm; and a grapple coupled to the movable part of the coupling portion, including first and second jaws, one of the jaws being pivoted to open and close against the other of the jaws, wherein each of the first and second jaws has an aspect ratio, which is defined by the ratio of its length to its front-to-back depth, being at least approximately 2:1.

25. A grapple assembly, comprising:

a coupling portion, including a fixed part structured to be coupled to a link pivot and to a dipper pivot of an arm of an equipment, a movable part, and a swinger mechanism for rotating the movable part about a swinger axis approximately aligned with an imaginary line drawn between the link pivot and the dipper pivot when the grapple assembly is coupled to the arm; and a grapple coupled to the movable part of the coupling portion, including first and second jaws, one of the jaws being pivoted to open and close against the other of the jaws, wherein a distal end of each of the first and second jaws includes tines that interlace with the tines of the other law when the jaws are closed together.

26. A grapple assembly, comprising:

a coupling portion, including a fixed part structured to be coupled to a link pivot and to a dipper pivot of an arm of an equipment, a movable part, and a swinger mechanism for rotating the movable part about a swinger axis approximately aligned with an imaginary line drawn between the link pivot and the dipper pivot when the grapple assembly is coupled to the arm; and a grapple coupled to the movable part of the coupling portion, including first and second jaws, one of the jaws being pivoted to open and close against the other of the jaws, wherein each of the first and second jaws includes a plate extending across the law that inhibits material being held by the grapple from falling out of the grapple.

27. A grapple for coupling to a tool coupler that connects to a link pivot and a dipper pivot on an arm of an equipment, comprising:

a fixed portion, including connecting structure for removably connecting to the tool coupler;

a first grapple law extending from the fixed portion in a fixed direction relative to the fixed portion;

a movable second grapple law being coupled to the first grapple law at a grapple pivot for rotation of the second grapple jaw between open and closed positions relative to the first grapple jaw, wherein each of the first and the second grapple jaws includes spaced side members and a connecting member connecting between the side members; and a hydraulic grapple actuator having a first end mounted to the second grapple law and a second end mounted to a fixed member on the grapple for rotating the second grapple law between the open and closed positions.

28. The grapple of claim 27, wherein the first jaw comprises a fixed law that extends in a direction substantially parallel to an imaginary line drawn between the link pivot and the dipper pivot when the grapple is coupled to the arm.

29. The grapple of claim 27, wherein the connecting structure comprises a fitting adapted to engage with a latch pin from the tool coupler.

* * * * *